US007377365B2

(12) United States Patent
Abe et al.

(10) Patent No.: US 7,377,365 B2
(45) Date of Patent: May 27, 2008

(54) MULTI-DECK ELEVATOR EQUIPPED BUILDING

(75) Inventors: Shigeru Abe, Tokyo (JP); Shiro Hikita, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 483 days.

(21) Appl. No.: 10/530,650

(22) PCT Filed: Nov. 27, 2003

(86) PCT No.: PCT/JP03/15174

§ 371 (c)(1),
(2), (4) Date: Apr. 7, 2005

(87) PCT Pub. No.: WO2005/051828

PCT Pub. Date: Jun. 9, 2005

(65) Prior Publication Data

US 2006/0042884 A1 Mar. 2, 2006

(51) Int. Cl.
*B66B 1/34* (2006.01)

(52) U.S. Cl. ..... 187/396; 187/902

(58) Field of Classification Search ..... 187/247, 187/380–388, 391–396, 902
See application file for complete search history.

(56) References Cited

U.S. PATENT DOCUMENTS 1,914,128 A 6/1933 James et al.
4,655,325 A * 4/1987 Schroder et al. ..... 187/387
4,836,336 A * 6/1989 Schroder ..... 187/384
6,062,346 A * 5/2000 Friedli et al. ..... 187/395
7,093,693 B1 * 8/2006 Gazdzinski ..... 187/384
7,108,106 B2 * 9/2006 Kostka ..... 187/391

FOREIGN PATENT DOCUMENTS

| | | |
|---|---|---|
| JP | 49-82043 | 8/1974 |
| JP | 3-147685 | 6/1991 |
| JP | 7-228435 | 8/1995 |
| JP | 8-175775 | 7/1996 |
| JP | 9-221277 | 8/1997 |
| JP | 11-71063 | 3/1999 |
| JP | 2003-81540 | 3/2003 |

* cited by examiner

*Primary Examiner*—Jonathan Salata
(74) *Attorney, Agent, or Firm*—Leydig, Voit & Mayer, Ltd.

(57) ABSTRACT

In a multi-deck-elevator-equipped building control system, operating modes of an elevator control portion include a double operating mode. In the double operating mode, only a first cage is permitted to stop at first cage stop floors, and only a second cage is permitted to stop at second cage stop floors that are distinct from the first cage stop floors. A building fixture control portion has a first group control portion for associatively controlling an electrical fixture on the first cage stop floors and a second group control portion for associatively controlling an electrical fixture on the second cage stop floors.

4 Claims, 14 Drawing Sheets

MULTI-DECK ELEVATOR EQUIPPED BUILDING

TECHNICAL FIELD

The present invention relates to a multi-deck elevator in which an elevator car having a first cage and a second cage positioned above the first cage is raised and lowered inside a hoistway, to a multi-deck-elevator-equipped building in which the multi-deck elevator is installed, and to a control system therefor.

BACKGROUND ART

Conventional double-deck elevators have been disclosed in which an elevator car having a lower car and an upper car positioned above the lower car is raised and lowered inside a hoistway, such as in Japanese Patent Laid-Open No. HEI 11-71063 (Gazette), for example.

Operating modes of conventional double-deck elevators include a double operating mode and a semi-double operating mode. In the double operating mode, the lower car stops only at odd-numbered floors, and the upper car stops only at even-numbered floors. In the semi-double operating mode, a distribution similar to that of the double operating mode is performed only at departure floors (normally the first floor and the second floor), and once a landing call has been answered, both the lower car and the upper car stop at any floor. If the departure floors are the first floor and the second floor, escalators are used for movement between the first and second floors.

The operating mode is switched depending on degrees of congestion. Specifically, the double operating mode, which has a high transport efficiency, is implemented during periods of peak congestion, and the semi-double operating mode is implemented outside peak periods.

However, in a conventional building occupied by a plurality of tenants, the tenants occupy vertically continuous floors, such as Company A occupying eight and ninth floors, Company B occupying tenth through fourteenth floors, and Company C occupying fifteenth through eighteenth floors, for example. During peak periods in which the double operating mode is implemented, since the double-deck elevator cannot be used for movement between odd-numbered floors and even-numbered floors even inside the same company, the tenants are forced to use stairs.

In contrast to this, if the semi-double operating mode is implemented during peak periods, transport capacity decreases and waiting time is increased.

Consequently, there is demand for utilization efficiency of the double-deck elevator to be improved, and for user friendliness to be increased.

DISCLOSURE OF THE INVENTION

The present invention aims to solve the above problems and an object of the present invention is to provide a multi-deck-elevator-equipped building, a control system therefor, and a multi-deck elevator enabling user friendliness to be improved.

In order to achieve the above object, according to one aspect of the present invention, there is provided a multi-deck-elevator-equipped building control system including: an elevator control portion for controlling raising and lowering of an elevator car having: a first cage; and a second cage positioned above the first cage, the elevator car being raised and lowered inside a hoistway of a building main body; and a building fixture control portion for controlling an electrical fixture installed on floors of the building main body, wherein: operating modes of the elevator control portion include a double operating mode in which only the first cage is permitted to stop at a plurality of first cage stop floors, and only the second cage is permitted to stop at a plurality of second cage stop floors that are distinct from the first cage stop floors; and the building fixture control portion has: a first group control portion for associatively controlling the electrical fixture on the first cage stop floors; and a second group control portion for associatively controlling the electrical fixture on the second cage stop floors.

According to another aspect of the present invention, there is provided a multi-deck-elevator-equipped building including: a building main body in which a hoistway is disposed; an elevator car having: a first cage; and a second cage positioned above the first cage, the elevator car being raised and lowered inside the hoistway; an elevator control portion for controlling raising and lowering of the elevator car; an electrical fixture installed on floors of the building main body; and a building fixture control portion for controlling the electrical fixture, wherein: the building main body has: a plurality of first cage stop floors; and a plurality of second cage stop floors that are distinct from the first cage stop floors; operating modes of the elevator control portion include a double operating mode in which only the first cage is permitted to stop at the first cage stop floors, and only the second cage is permitted to stop at the second cage stop floors; and the building fixture control portion has: a first group control portion for associatively controlling the electrical fixture on the first cage stop floors; and a second group control portion for associatively controlling the electrical fixture on the second cage stop floors.

According to yet another aspect of the present invention, there is provided a multi-deck-elevator-equipped building including: a building main body in which a hoistway is disposed; an elevator car having: a first cage; and a second cage positioned above the first cage, the elevator car being raised and lowered inside the hoistway; an elevator control portion for controlling raising and lowering of the elevator car; and an electrical fixture installed on floors of the building main body, wherein: the building main body has: a plurality of first cage stop floors; and a plurality of second cage stop floors that are distinct from the first cage stop floors; operating modes of the elevator control portion include a double operating mode in which only the first cage is permitted to stop at the first cage stop floors, and only the second cage is permitted to stop at the second cage stop floors; a first duct extending so as to pass through a second cage stop floor is disposed between vertically-neighboring first cage stop floors, and a second duct extending so as to pass through a first cage stop floor is disposed between vertically-neighboring second cage stop floors; and first electrical wiring electrically connected to the electrical fixture on the first cage stop floors is accommodated in the first duct, and second electrical wiring electrically connected to the electrical fixture on the second cage stop floors is accommodated in the second duct.

According to still yet another aspect of the present invention, there is provided a multi-deck-elevator-equipped building including: a building main body in which a hoistway and a stairway are disposed; an elevator car having: a first cage; and a second cage positioned above the first cage, the elevator car being raised and lowered inside the hoistway; and an elevator control portion for controlling raising and lowering of the elevator car, wherein: the building main body has: a plurality of first cage stop floors; and a plurality of second cage stop floors that are distinct from the first cage stop floors; operating modes of the elevator control portion include a double operating mode in which only the first cage is permitted to stop at the first cage stop floors, and only the second cage is permitted to stop at the second cage stop floors; the stairway has: first stairs connecting the first cage stop floors to each other, and second stairs connecting the second cage stop floors to each other; and the first stairs and the second stairs are separated from each other and movement between the first cage stop floors and the second cage stop floors using the stairway is restricted.

According to another aspect of the present invention, there is provided a multi-deck-elevator-equipped building including: a building main body in which a hoistway is disposed; an elevator car having: a first cage; and a second cage positioned above the first cage, the elevator car being raised and lowered inside the hoistway; and an elevator control portion for controlling raising and lowering of the elevator car, wherein: the building main body has: a plurality of first cage stop floors; and a plurality of second cage stop floors that are distinct from the first cage stop floors; operating modes of the elevator control portion include a double operating mode in which only the first cage is permitted to stop at the first cage stop floors, and only the second cage is permitted to stop at the second cage stop floors; and first distances being inter-floor distances between the second cage stop floors and the first cage stop floors adjacent below are all equal, and second distances being inter-floor distances between the second cage stop floors and the first cage stop floors adjacent above are varied on at least a portion of the floors.

According to yet another aspect of the present invention, there is provided a multi-deck elevator including: an elevator car having: a first cage; and a second cage positioned above the first cage, the elevator car being raised and lowered inside a hoistway; and an elevator control portion for controlling raising and lowering of the elevator car, wherein: operating modes of the elevator control portion include a double operating mode in which only the first cage is permitted to stop at the first cage stop floors, and only the second cage is permitted to stop at the second cage stop floors; a first designating button apparatus having a plurality of first direct designating buttons for designating the first cage stop floors as destination floors and making direct designation of the second cage stop floors impossible is installed in at least one position inside the first cage and a landing of the first cage stop floors; a second designating button apparatus having a plurality of second direct designating buttons for designating the second cage stop floors as destination floors and making direct designation of the first cage stop floors impossible is installed in at least one position inside the second cage and a landing of the second cage stop floors; a first indirect designating button for indirectly designating the second cage stop floors as destination floors by being operated in combination with the first direct designating buttons is disposed on the first designating button apparatus; and a second indirect designating button for indirectly designating the first cage stop floors as destination floors by being operated in combination with the second direct designating buttons is disposed on the second designating button apparatus.

BEST MODE FOR CARRYING OUT THE INVENTION

Preferred embodiments of the present invention will now be explained with reference to the drawings.

EMBODIMENT 1

Figure 1:
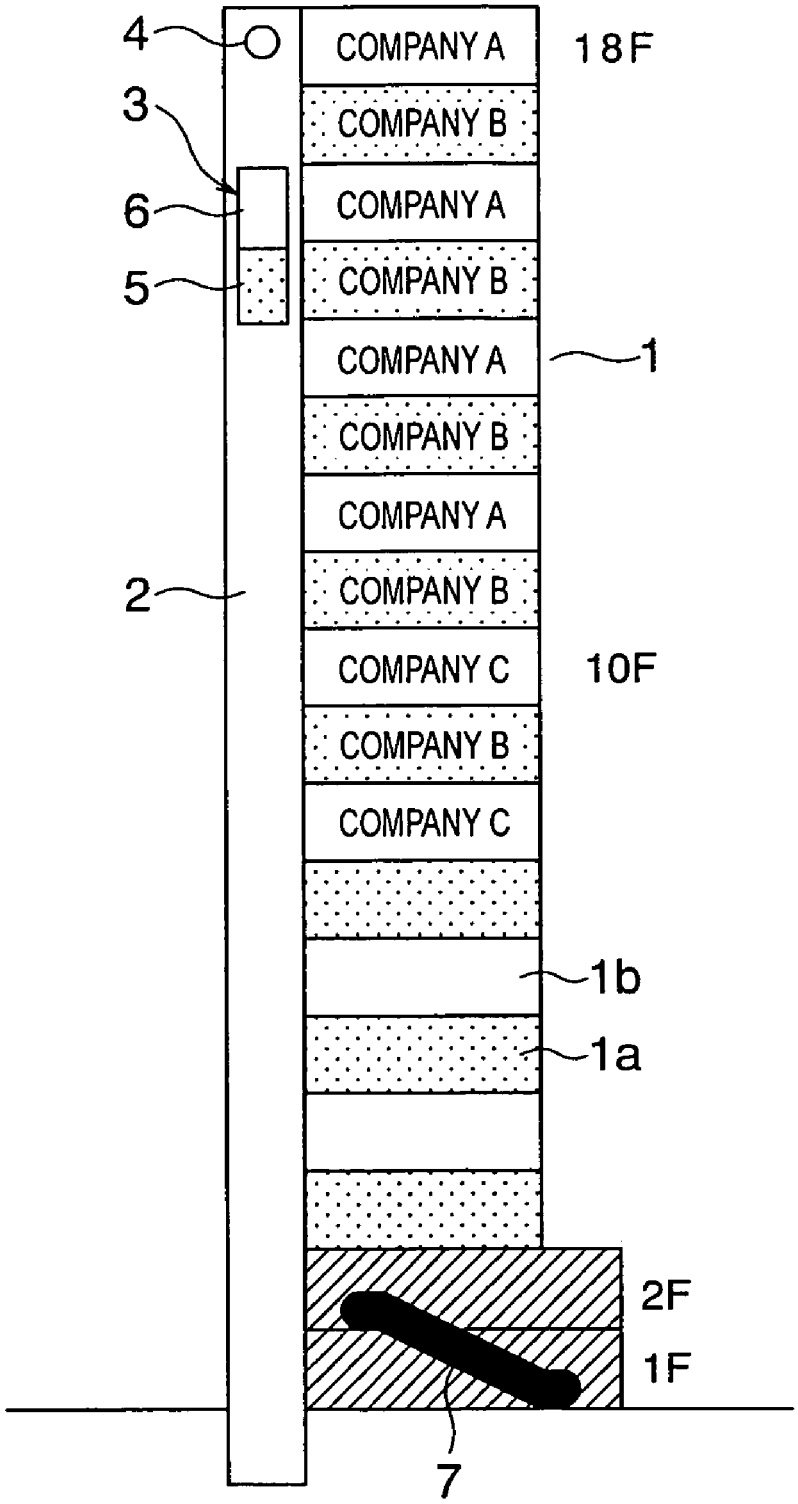
FIG. 1 is a schematic structural diagram showing a multi-deck-elevator-equipped building according to Embodiment 1 of the present invention.

FIG. 1 is a schematic structural diagram showing a multi-deck-elevator-equipped building according to Embodiment 1 of the present invention. In the figure, a hoistway 2 extending vertically and continuously from a first floor (1F) to an eighteenth floor (18F) is disposed in an 18-story building main body 1. An elevator car 3 is disposed inside the hoistway 2. The elevator car 3 is suspended inside the hoistway 2 by a main rope (not shown), and is raised and lowered inside the hoistway 2 by a driving force from an elevator driving machine (a hoisting machine) 4.

The elevator car 3 has: a lower cage 5 functioning as a first cage; an upper cage 6 functioning as a second cage positioned above the lower cage 5; and a car frame (not shown) supporting the lower cage 5 and the upper cage 6. The upper cage 6 and the lower cage 5 are raised and lowered inside the hoistway 2 together.

An entrance of the building main body 1 is positioned on the first floor (1F), and the first floor (1F) and a second floor (2F) constitute departure floors (entrance floors) of the elevator car 3. Escalators 7 are installed between the first floor (1F) and the second floor (2F) of the building main body 1.

The building main body 1 includes: a plurality of lower cage stop floors 1*a*, being floors at which the first cage stops; and a plurality of upper cage stop floors 1*b*, being floors at which the second cage stops. The lower cage stop floors 1*a* and the upper cage stop floors 1*b* are mutually-distinct floors. Specifically, the lower cage stop floors 1*a* are set so as to be odd-numbered floors from a third floor (3F) upward, and the upper cage stop floors 1*b* are set so as to be even-numbered floors from a fourth floor (4F) upward, respectively. Thus, the lower cage stop floors 1*a* and the upper cage stop floors 1*b* are disposed alternately in a vertical direction.

A multi-deck elevator according to Embodiment 1 (in this case a double-deck elevator) is basically operated in a double operating mode. In the double operating mode, only the lower cage 5 stops (lands) at the lower cage stop floors 1*a*, and only the upper cage 6 stops (lands) at the upper cage stop floors 1*b*.

In Embodiment 1, as a method for using the building main body 1, if a single tenant (a company, an organization, etc.) occupies a plurality of floors, the tenant is placed only on either lower cage stop floors 1*a* or upper cage stop floors 1*b*.

For example, in FIG. 1, Company A occupies a twelfth floor (12F), a fourteenth floor (14F), a sixteenth floor (16F), and the eighteenth floor (18F), which are upper cage stop floors, 1*b*. Company B occupies a ninth floor (9F), an eleventh floor (11F), a thirteenth floor (13F), a fifteenth floor (15F), and a seventeenth floor (17F), which are lower cage stop floors 1*b*. Company C occupies an eighth floor (8F) and a tenth floor (10F), which are upper cage stop floors 1*b*.

Figure 2:
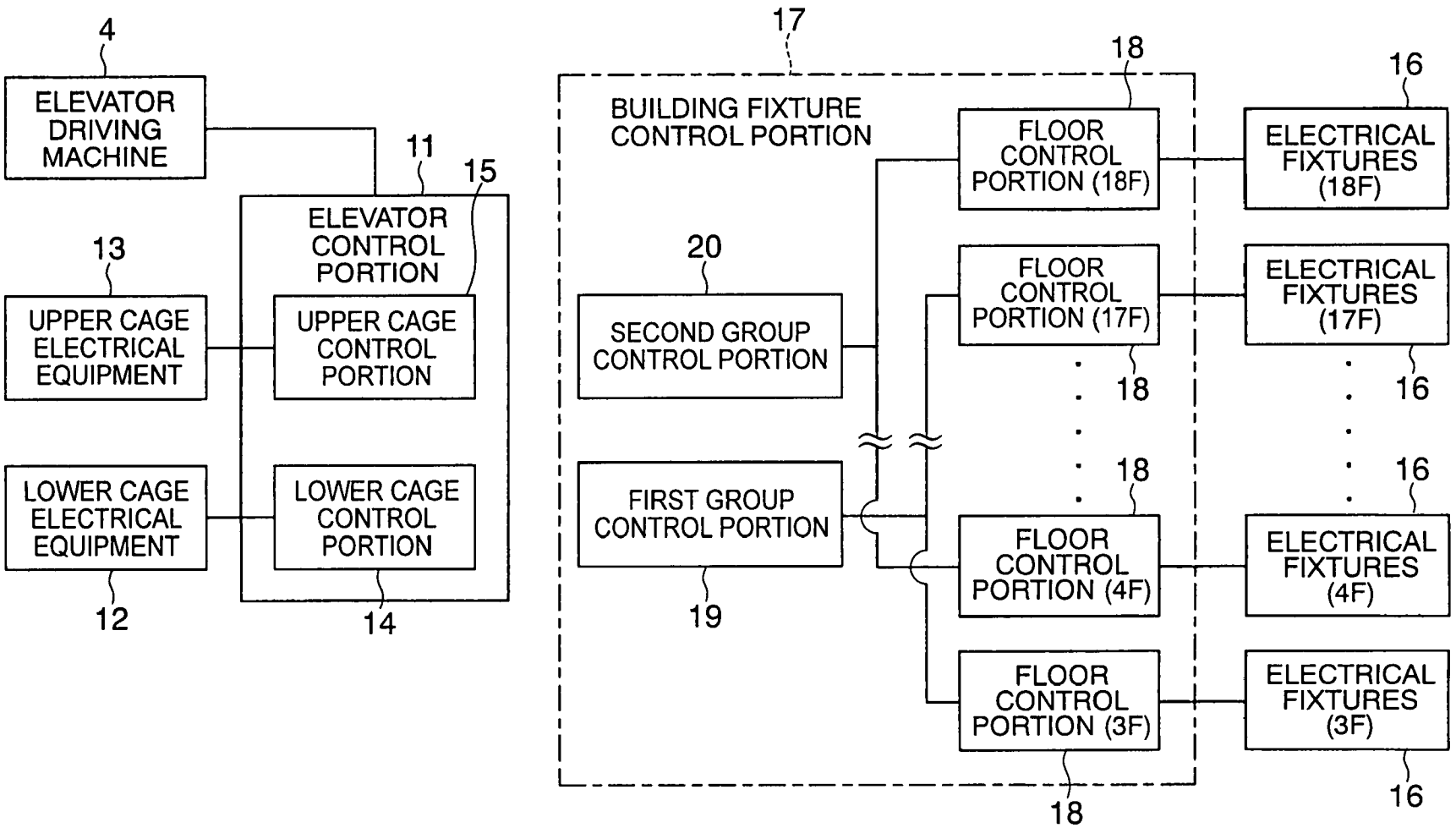
FIG. 2 is a block diagram showing a control system of the multi-deck-elevator-equipped building in FIG. 1.

FIG. 2 is a block diagram showing a control system of the multi-deck-elevator-equipped building in FIG. 1. The raising and lowering of the elevator car 3 by the elevator driving machine 4 is controlled by an elevator control portion 11. Lower cage electrical equipment 12 functioning as first cage electrical equipment is mounted to the lower cage 5. Upper cage electrical equipment 13 functioning as second cage electrical equipment is mounted to the upper cage 6.

Examples of lower cage electrical equipment 12 and upper cage electrical equipment 13 include lighting apparatuses, air conditioning apparatuses, door motors, car button apparatuses, broadcasting apparatuses, display apparatuses, etc.

A lower cage control portion 14 functioning as a first cage control portion for controlling the lower cage electrical equipment 12 and an upper cage control portion 15 functioning as a second cage control portion for controlling the upper cage electrical equipment 13 are disposed in the elevator control portion 11.

Electrical fixtures 16 are installed on each of the lower cage stop floors 1*a* and the upper cage stop floors 1*b* of the building main body 1 (in this case the third through eighteenth floors). Examples of electrical fixtures 16 include lighting apparatuses, air conditioning apparatuses, room entry management apparatuses, broadcasting apparatuses, display apparatuses, etc.

The electrical fixtures 16 are controlled by a building fixture control portion 17. The building fixture control portion 17 has: a plurality of floor control portions 18 for controlling the electrical fixtures 16 on a corresponding floor; a first group control portion 19 for associatively controlling the floor control portions 18 corresponding to the lower cage stop floors 1*a*; and a second group control portion 20 for associatively controlling the floor control portions 18 corresponding to the upper cage stop floors 1*b*.

In other words, if we assume that electrical fixtures 16 disposed on the lower cage stop floors 1*a* constitute a first group, and electrical fixtures 16 disposed on the upper cage stop floors 1*b* constitute a second group, then the first and second group control portions 19 and 20 control the electrical fixtures 16 for each respective group.

If, for example, the electrical fixtures 16 controlled by the first and second group control portions 19 and 20 are lighting apparatuses, then switching on and off, brightness, etc., can be controlled collectively in each group, for example. If the electrical fixtures 16 are air conditioning apparatuses, then switching on and off, temperature settings, etc., can be controlled collectively in each group, for example.

In addition, if the electrical fixtures 16 are security systems (security equipment) such as room entry management apparatuses, etc., then security levels, switching on and off of locks, management of identification information, etc., can be controlled collectively in each group, for example. Furthermore, mutually-distinct types of security systems can be installed on the lower cage stop floors 1*a* and the upper cage stop floors 1*b* and respectively controlled collectively in each group. Still furthermore, if the electrical fixtures 16 are broadcasting apparatuses, then announcements, background music, etc., can be controlled collectively in each group, for example.

If the electrical fixtures 16 are display apparatuses, then displayed messages, displayed images, etc., can be controlled collectively in each group, for example. In other words, control of each group corresponding to the lower cage 5 and the upper cage 6 can be performed for any kind of electrical fixture 16.

In a multi-deck-elevator-equipped building of this kind, the elevator is operated in the double operating mode, and the floors at which the lower cage 5 and the upper cage 6 stop are basically fixed. The electrical fixtures 16 are divided into groups constituted by the lower cage stop floors 1*a* and the upper cage stop floors 1*b*, and control of each group is performed by the first and second group control portions 19 and 20.

Consequently, placement of tenants so as to be distributed on the lower cage stop floors 1*a* and the upper cage stop floors 1*b* as shown in FIG. 1 is facilitated. By adopting this form of occupancy, movement between odd-numbered floors and even-numbered floors inside each company is eliminated, relieving inconvenience due to continuous implementation of the double operating mode. By implementing the double operating mode continuously, transport capacity is improved, and waiting time is shortened. Thus, the multi-deck-elevator-equipped building can have superior utilization efficiency and improved user friendliness for tenants.

Since floors corresponding to the lower cage 5 and floors corresponding to the upper cage 6 are separated, decoration of the lower cage 5 and decoration of the upper cage 6 can be mutually distinct. In other words, color, decoration, etc., of interior design (car doors, cage wall panels, cage floor, cage ceiling, car interior lighting, etc.) of the lower cage 5 can be matched with color, decoration, etc., of landings (landing doors, landing walls, door frames, landing floors, landing lighting, etc.) of the lower cage stop floors 1*a*, and color, decoration, etc., of interior design of the upper cage 6 can be matched with color, decoration, etc., of landings of the upper cage stop floors 1*b*.

In this manner, design can be improved, and passengers can be prevented from alighting at the wrong floor. Furthermore, elevator decor can be tailored to the wishes of the tenants.

Figure 3:
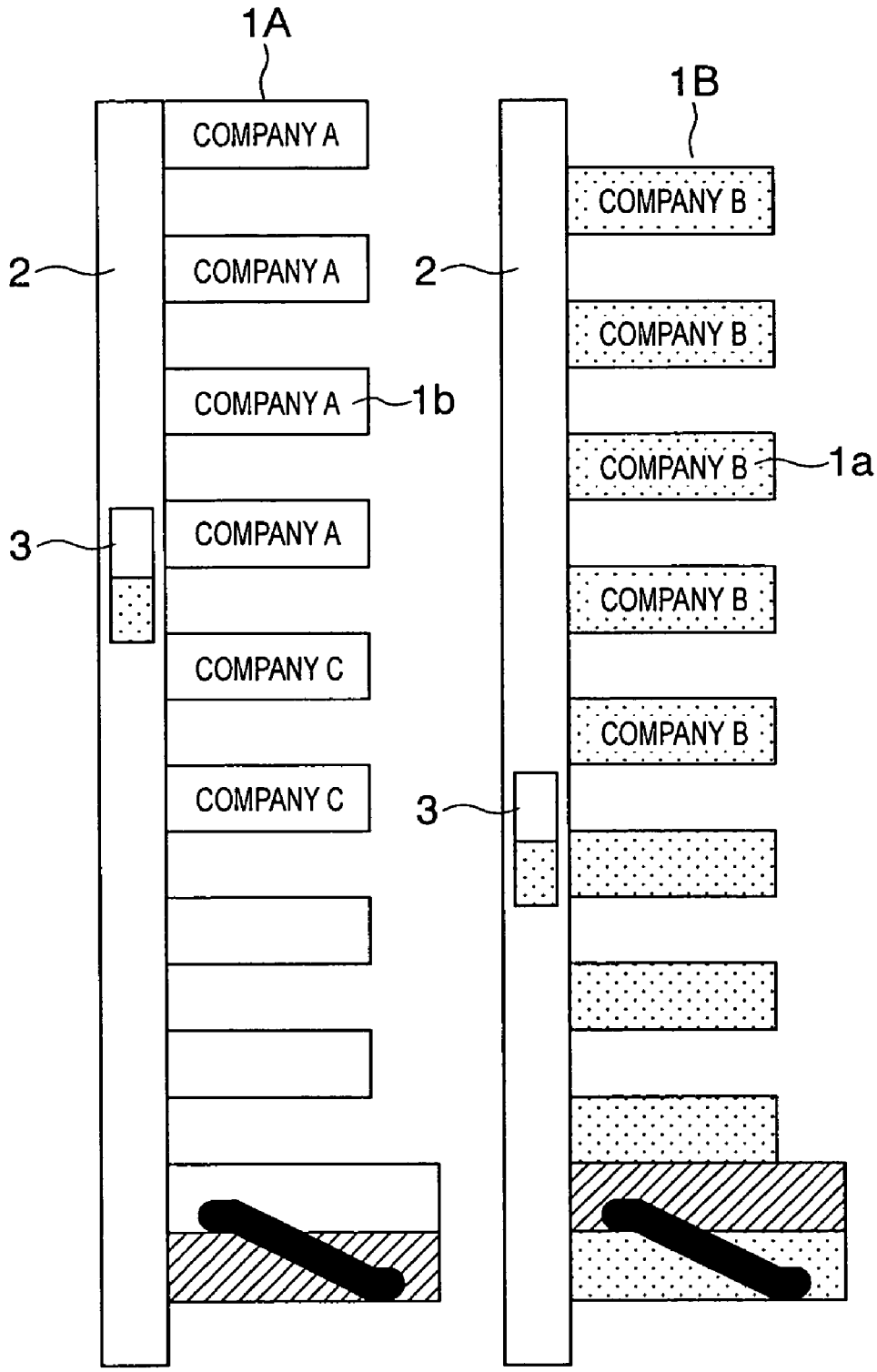
FIG. 3 is an explanatory diagram showing a different way of visualizing a method for using a building main body such as that in FIG. 1.

Now, FIG. 3 is an explanatory diagram showing a different way of visualizing a method for using a building main body such as that in FIG. 1. In FIG. 3, an even-numbered floor group is present in a first building main body 1A, an odd-numbered floor group is present in a second building main body 1B, and a multi-deck elevator functioning as a means of transportation is used jointly in the first and second building main bodies 1A and 1B. Thus, the method of use of the building main body 1 shown in FIG. 1 can also be said to be similar to the method of use shown in FIG. 3 from the viewpoints of use of the building and control of the elevator.

Moreover, in the elevator control portion 11 according to Embodiment 1, the double operating mode is basically implemented, but in special cases such as when complicated procedures are required to move a wheelchair user to the second floor (2F), for example, or when tenants are moving their offices, etc., it is preferable to be able to switch to other operating modes such as semi-double operating mode, etc. For that purpose, a special button for wheelchair users may also be disposed on the landing of the first floor (1F), for example, such that the upper cage 6 stops at the first floor (1F) when the special button is pressed.

In addition, to move between the even-numbered floors and the odd-numbered floors during implementation of the double operating mode, the elevator can be used to descend to the first floor (1F) or the second floor (2F), movement between the first floor (1F) and the second floor (2F) can be performed using the escalators 7, and the destination floor can be reached by using the elevator again. Movement of this kind is complicated compared to movement between floors occupied by a single tenant, but this should not be a problem since the frequency of such movement is normally much lower than that of movement between the floors occupied by the single tenant.

EMBODIMENT 2

Figure 4:
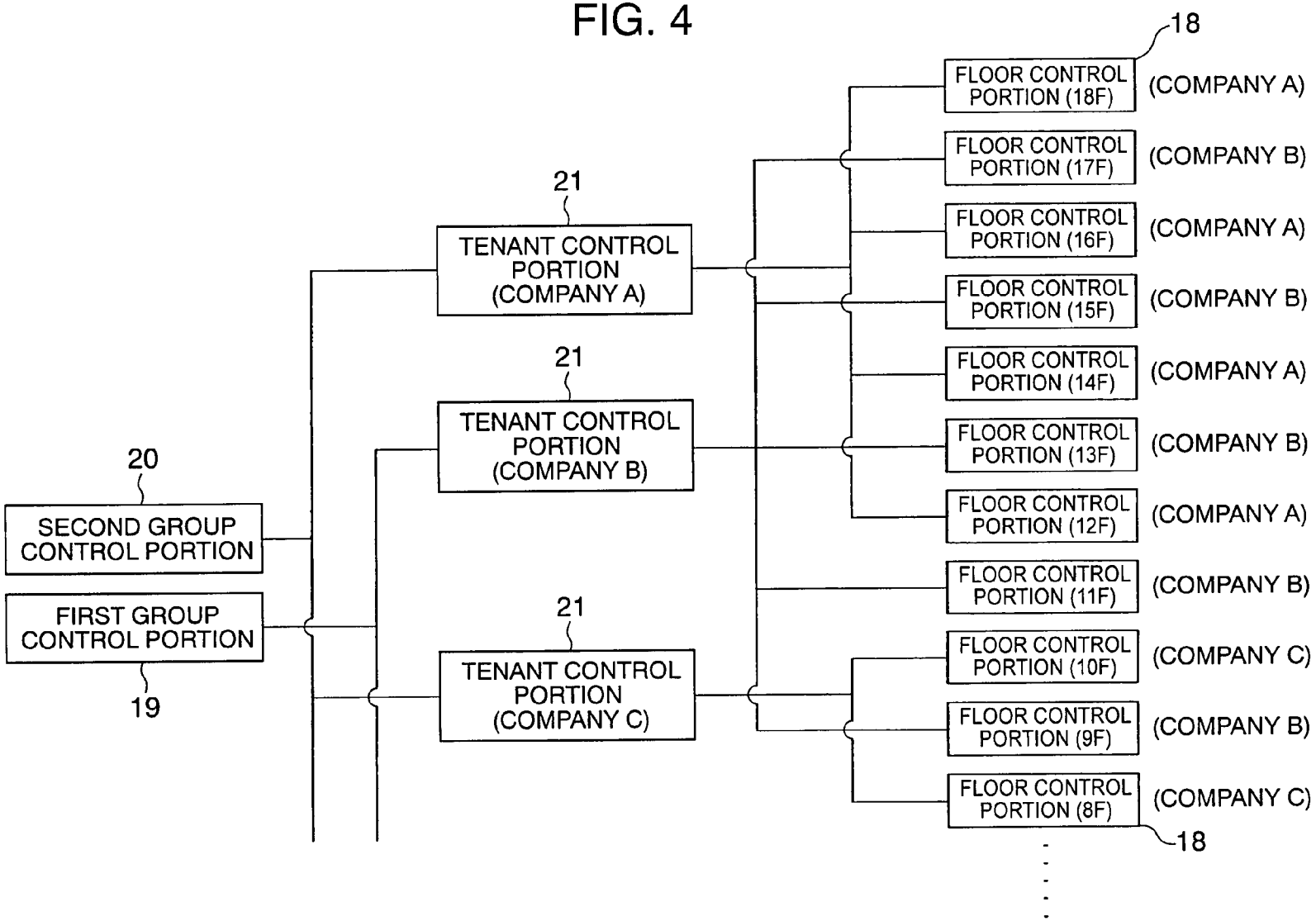
FIG. 4 is a block diagram showing part of a control system of a multi-deck-elevator-equipped building according to Embodiment 2 of the present invention.

Next, FIG. 4 is a block diagram showing part of a control system of a multi-deck-elevator-equipped building according to Embodiment 2 of the present invention. In the figure, tenant control portions 21 for associatively controlling electrical fixtures 16 (see FIG. 2) for corresponding tenants are disposed between floor control portions 18 of a building fixture control portion and first and second group control portions 19 and 20. The rest of the configuration is similar to that of Embodiment 1.

In a multi-deck-elevator-equipped building of this kind, if a plurality of tenants are present on at least one floor group constituted by the odd-numbered floor group and the even-numbered floor group (in FIG. 1, for example, Company B and Company C occupy the lower cage stop floors 1*a*), control of the electrical fixtures 16 for each of the tenants can be implemented using respective tenant control portions 21. Control of the electrical fixtures 16 in each of the groups constituted by the group of lower cage stop floors 1*a* and the group of upper cage stop floors 1*b* can also be implemented using the first and second group control portions 19 and 20, respectively, in a similar manner to Embodiment 1.

Moreover, in FIG. 4, the tenant control portions 21 are shown between the floor control portions 18 and the group control portions 19 and 20, but because the tenant control portions 21 each belong to only one of the group control portions 19 and 20, the tenant control portions 21 can also be considered to be disposed inside the group control portions 19 and 20 as part of the group control portions 19 and 20.

EMBODIMENT 3

Figure 5:
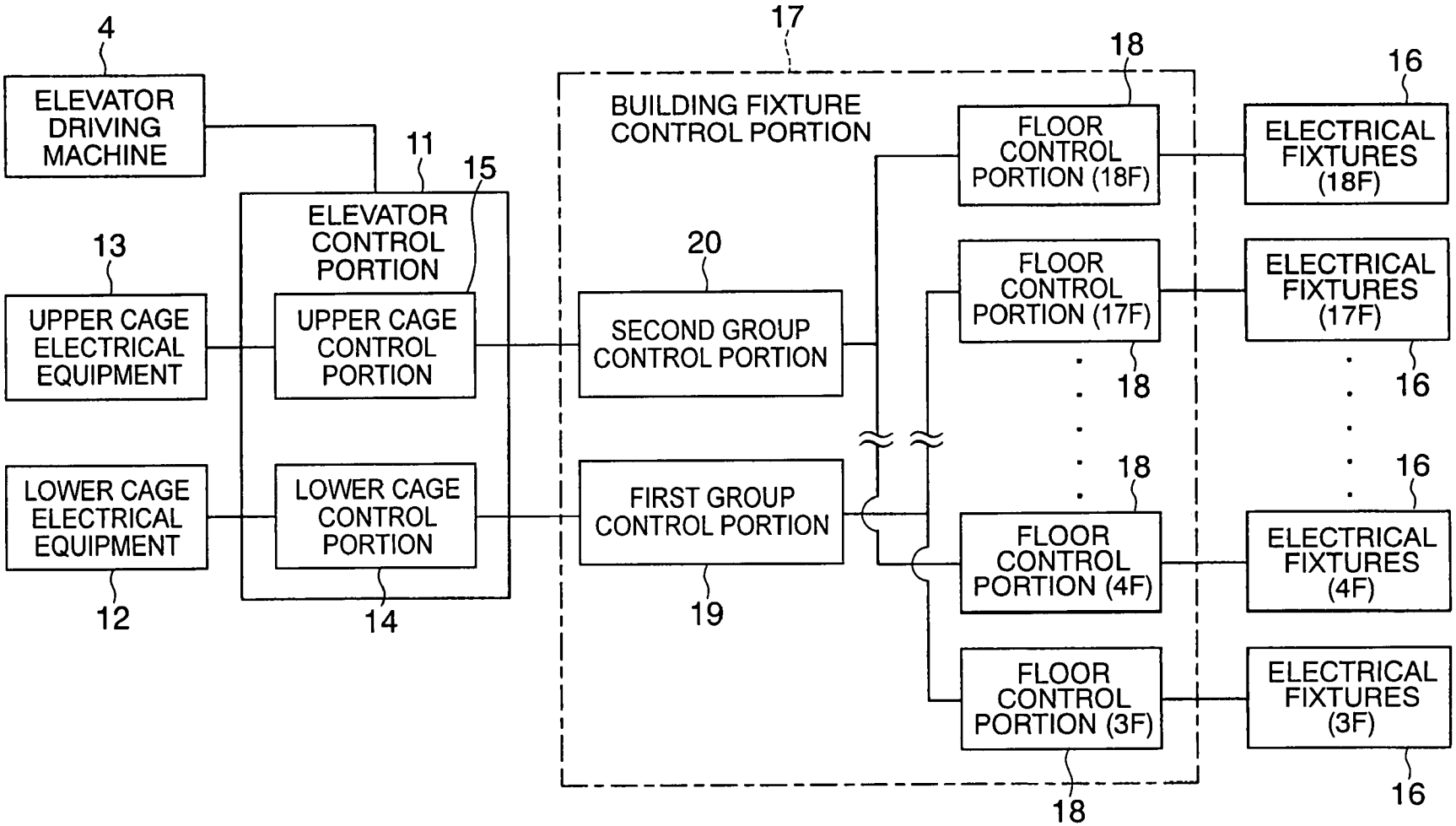
FIG. 5 is a block diagram showing a control system of a multi-deck-elevator-equipped building according to Embodiment 3 of the present invention.

Next, FIG. 5 is a block diagram showing a control system of a multi-deck-elevator-equipped building according to Embodiment 3 of the present invention. In the figure, a first group control portion 19 is connected to a lower cage control portion 14. The lower cage control portion 14 performs control in response to information from the first group control portion 19 for at least some equipment among lower cage electrical equipment 12.

A second group control portion 20 is connected to an upper cage control portion 15. The upper cage control portion 15 performs control in response to information from the second group control portion 20 for at least some equipment among upper cage electrical equipment 13. The rest of the configuration is similar to that of Embodiment 1.

If, for example, the electrical fixtures 16 controlled by the first and second group control portions 19 and 20 are lighting apparatuses, then switching on and off, brightness, etc., of lighting inside the lower cage 5 and the upper cage 6 can be controlled collectively with the lighting apparatuses of the building main body 1, for example. If the electrical fixtures 16 are air conditioning apparatuses, then switching on and off, temperature settings, etc., of air conditioning apparatuses inside the lower cage 5 and the upper cage 6 can be controlled collectively with the air conditioning apparatuses of the building main body 1, for example.

In addition, if the electrical fixtures 16 are security systems such as room entry management apparatuses, etc., then permissions for registering destination floors inside the lower cage 5 and the upper cage 6, and permissions for entering rooms at destination floors, etc., can be controlled collectively, for example.

As a specific example, personal information input apparatuses such as code input apparatuses, card readers, or fingerprint matching apparatuses, etc., can be disposed on car button apparatuses inside the lower cage 5 and the upper cage 6, for example, and in addition to determining permissions for destination floor registration in response to the information input by the personal information input apparatuses, determination of accessible doors at destination floors, etc., can also be performed simultaneously.

Still furthermore, if the electrical fixtures 16 are broadcasting apparatuses, then announcements, background music, etc., broadcast using the broadcasting apparatuses inside the lower cage 5 and the upper cage 6 can be controlled collectively with the broadcasting apparatuses of the building main body 1, for example.

If the electrical fixtures 16 are display apparatuses, then displayed messages, displayed images, etc., on display apparatuses inside the lower cage 5 and the upper cage 6 can be controlled collectively with the display apparatuses of the building main body 1, for example.

By associating control of the lower cage electrical equipment 12 and control of the electrical fixtures 16 of the odd-numbered floor group and associating control of the upper cage electrical equipment 13 and control of the electrical fixtures 16 of the even-numbered floor group in this manner, placement of tenants so as to be distributed on the lower cage stop floors 1*a* and the upper cage stop floors 1*b* as shown in FIG. 1 is further facilitated. Consequently, the multi-deck-elevator-equipped building can have superior utilization efficiency and improved user friendliness for tenants.

Moreover, tenant control portions 21 such as those shown in Embodiment 2 may also be disposed in the building fixture control portion 17 of Embodiment 3.

Placement of the floor control portions 18, the first and second group control portions 19 and 20, and the tenant control portions 21 is not limited to a particular location. For example, the floor control portions 18 may be disposed on each floor, or they may be disposed in a central control room, etc.

EMBODIMENT 4

Figure 6:
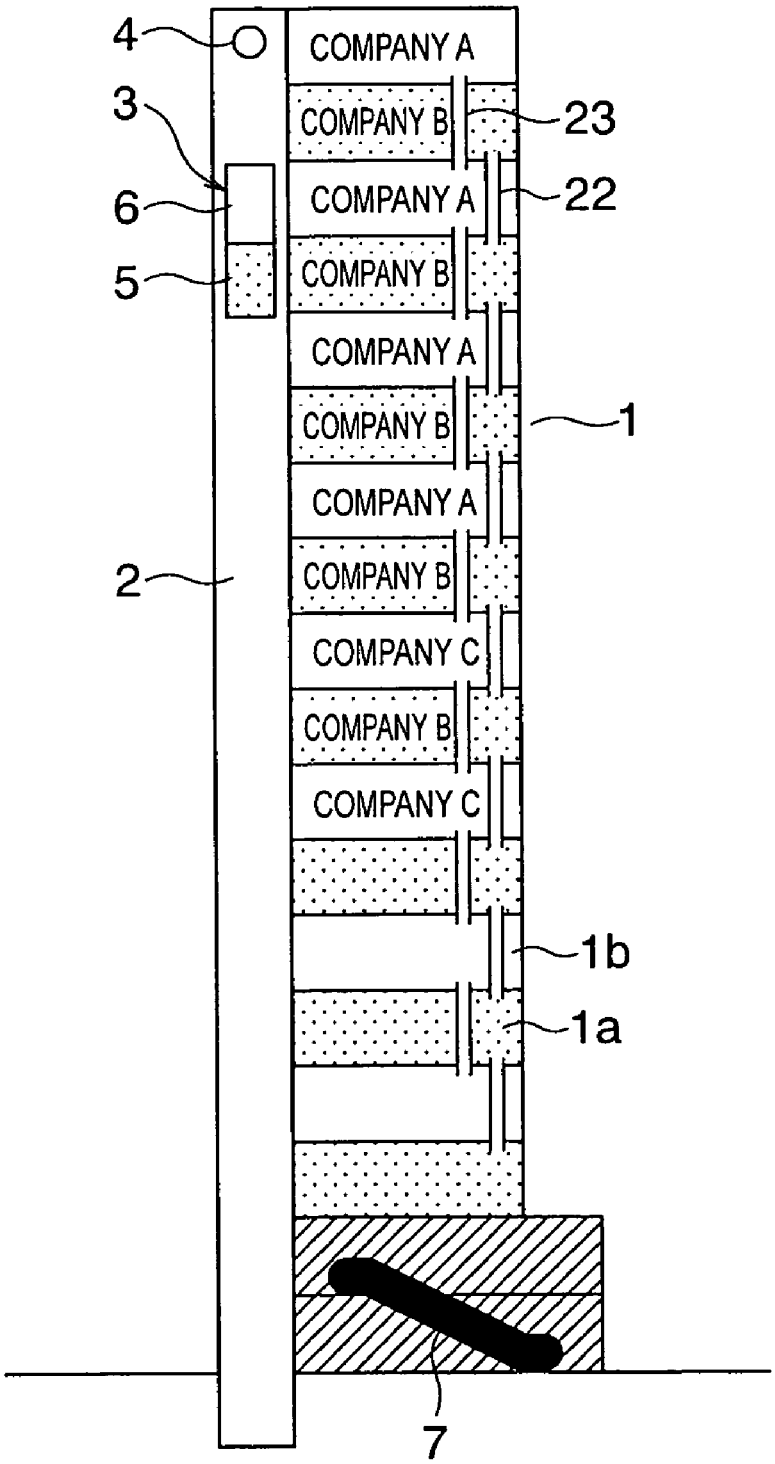
FIG. 6 is a schematic structural diagram showing, a multi-deck-elevator-equipped building according to Embodiment 4 of the present invention.

Next, FIG. 6 is a schematic structural diagram showing a multi-deck-elevator-equipped building according to Embodiment 4 of the present invention. In the figure, first ducts 22 extending so as to pass through upper cage stop floors 1*b* are installed between respective vertically-neighboring lower cage stop floors 1*a*. In other words, the first ducts 22 penetrate through the upper cage stop floors 1*b*. First electrical wiring (not shown) is accommodated in the first ducts 22. Signal cables, power cables, etc., connected to floor control portions 18 (see FIG. 2) of the lower cage stop floors 1*a* are included in the first electrical wiring.

Second ducts 23 extending so as to pass through the lower cage stop floors 1*a* are installed between respective vertically-neighboring upper cages top floors 1*b*. In other words, the second ducts 23 penetrate through the lower cage stop floors 1*a*. Second electrical wiring is accommodated in the second ducts 23. Signal cables, power cables, etc., connected to floor control portions 18 (see FIG. 2) of the upper cage stop floors 1*b* are included in the second electrical wiring.

The first electrical wiring and the second electrical wiring are separated into mutually-distinct wiring systems. For example, the floor control portions 18 and electrical fixtures 16 disposed on the lower cage stop floors 1*a*, as shown in FIG. 2, are connected to the first group control portion 19 by means of the signal cables of the first electrical wiring. The floor control portions 18 and the electrical fixtures 16 disposed on the upper cage stop floors 1*b* are connected to the second group control portion 20 by means of the signal cables of the second electrical wiring.

In a multi-deck-elevator-equipped building of this kind, because the first ducts 22 are disposed between the lower cage stop floors 1*a* and the second ducts 23 are disposed between the upper cage stop floors 1*b*, wiring systems for the lower cage stop floors 1*a* and the upper cage stop floors 1*b* can be separated easily.

Consequently, placement of tenants so as to be distributed on the lower cage stop floors 1*a* and the upper cage stop floors 1*b* is facilitated. By adopting this form of occupancy, the multi-deck-elevator-equipped building can have superior utilization efficiency and improved user friendliness for tenants.

EMBODIMENT 5

Figure 7:
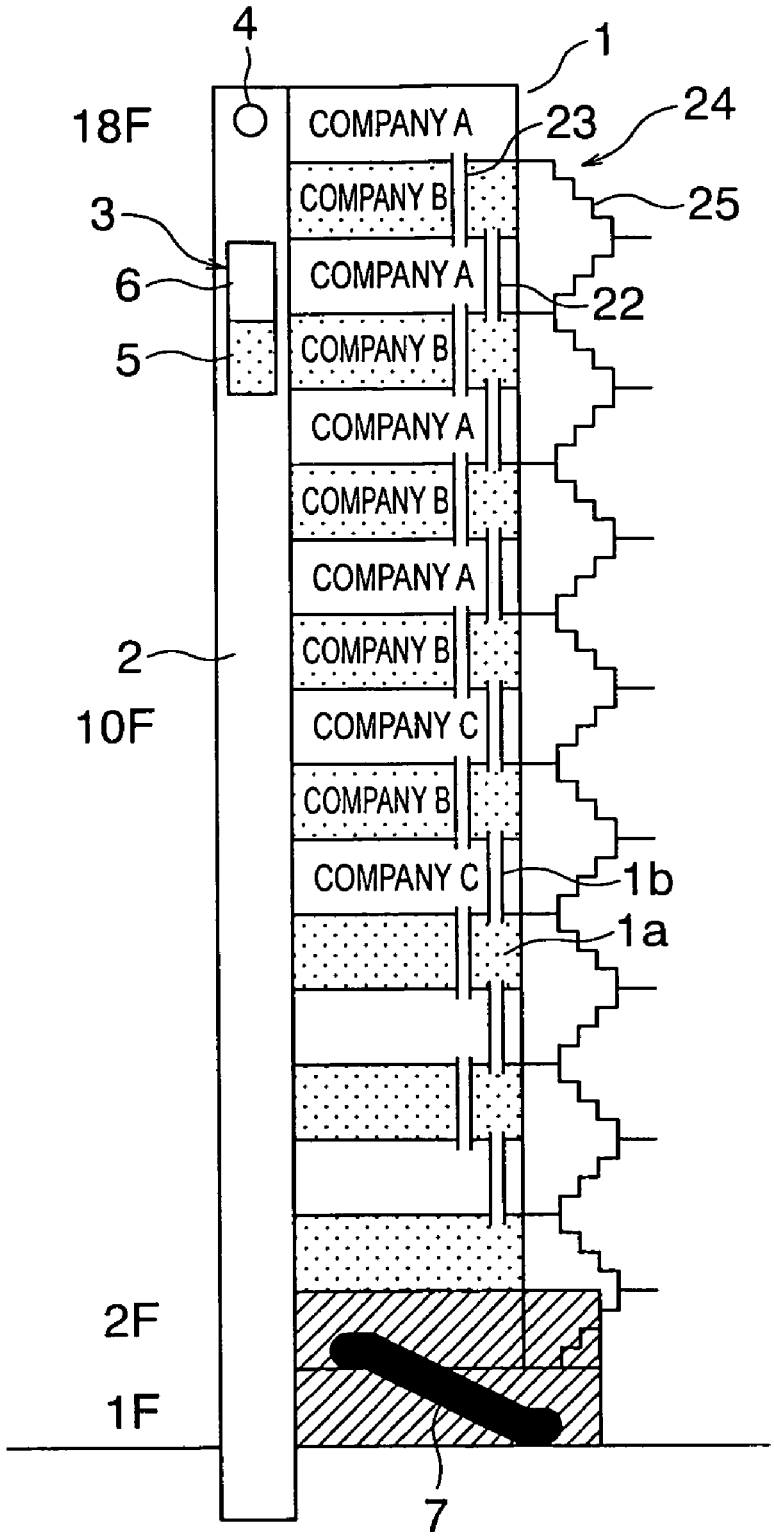
FIG. 7 is a schematic structural diagram showing a multi-deck-elevator-equipped building according to Embodiment 5 of the present invention.

Next, FIG. 7 is a schematic structural diagram showing a multi-deck-elevator-equipped building according to Embodiment 5 of the present invention. In the figure, a stairway 24 is disposed in a building main body 1. The stairway 24 has: first stairs (not shown) connecting lower cage stop floors 1*a* to each other; and second stairs 25 connecting upper cage stop floors 1*b* to each other. The first stairs and the second stairs 25 are separated from each other, and normally movement between the lower cage stop floors 1*a* and the upper cage stop floors 1*b* using the stairway 24 is restricted.

However, the first stairs and the second stairs 25 are connectable during emergencies. Specifically, a plurality of doors (not shown) are disposed between the first stairs and the second stairs 25, and the doors can be released in response to emergency signals such as fire detector signals, etc.

In a multi-deck-elevator-equipped building of this kind, since the first stairs for the lower cage stop floors 1*a* and the second stairs 25 for the upper cage stop floors 1*b* are separated from each other and movement between the lower cage stop floors 1*a* and the upper cage stop floors 1*b* is restricted, placement of tenants so as to be distributed on the lower cage stop floors 1*a* and the upper cage stop floors 1*b* is facilitated. By adopting this form of occupancy, the multi-deck-elevator-equipped building can have superior utilization efficiency and improved user friendliness for tenants.

Since the first stairs and the second stairs 25 are connectable during emergencies, the first stairs and the second stairs 25 can be used as emergency escape stairs.

Moreover, in Embodiment 5, an example is shown in which doors between the first stairs and the second stairs 25 can be released during an emergency, but the doors may also be made to open, for example, by operation with a specific key, or by fulfilling permission conditions of a passage management system, etc.

An emergency staircase that is usable from all floors in emergencies, etc., may also be disposed separately from the first stairs and the second stairs 25 used normally.

EMBODIMENT 6

Figure 8:
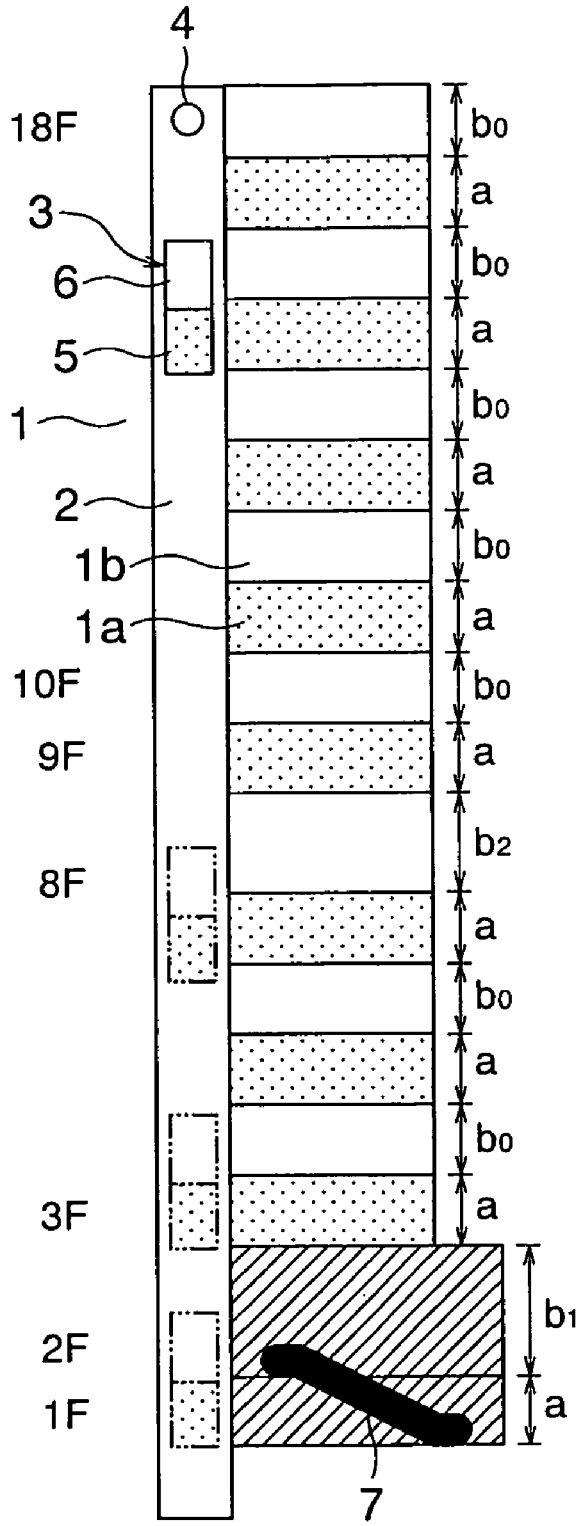
FIG. 8 is a schematic structural diagram showing a multi-deck-elevator-equipped building according to Embodiment 6 of the present invention.

Next, FIG. 8 is a schematic structural diagram showing a multi-deck-elevator-equipped building according to Embodiment 6 of the present invention. In the figure, an elevator car 3 is operated basically in a double operating mode. In the double operating mode, only a lower cage 5 stops (lands) at lower cage stop floors 1*a* (odd-numbered floors), and only an upper cage 6 stops (lands) at upper cage stop floors 1*b* (even-numbered floors).

A first distance (a), being an inter-floor distance between the upper cage stop floors 1*b* (even-numbered floors) and the lower cage stop floors 1*a* (odd-numbered floors) adjacent below, is equal for all floors. A second distance, being an inter-floor distance between the upper cage stop floors 1*b* (the even-numbered floors) and the lower cage stop floors 1*a* (odd-numbered floors) adjacent above, is varied for at least some of the floors. Specifically, a second distance (b1) between a second floor (2F) and a third floor (3F) and a second distance (b2) between an eighth floor (8F) and a ninth floor (9F) are greater than second distances (b0) of other floors.

In a multi-deck-elevator-equipped building of this kind, because some of the second distances are varied while keeping the first distance constant, some of the inter-floor distances can be varied without changing the distance between the first cage 5 and the second cage 6. Thus, ceiling height of the upper cage stop floors 1*b* can be increased, enabling design freedom to be improved and customer needs to be met. User friendliness can also be improved.

The first floor (1F) and the second floor (2F) can also be made into a mezzanine lobby, and entrance ceiling height can be designed to any height desired by an architect.

Moreover, in Embodiment 6, control of electrical fixtures, arrangement of electrical wiring, and arrangement of stairs, etc., have not been explained in detail, but user friendliness can be further improved by combining at least one of Embodiments 1 to 5 above with Embodiment 6.

Figure 9:
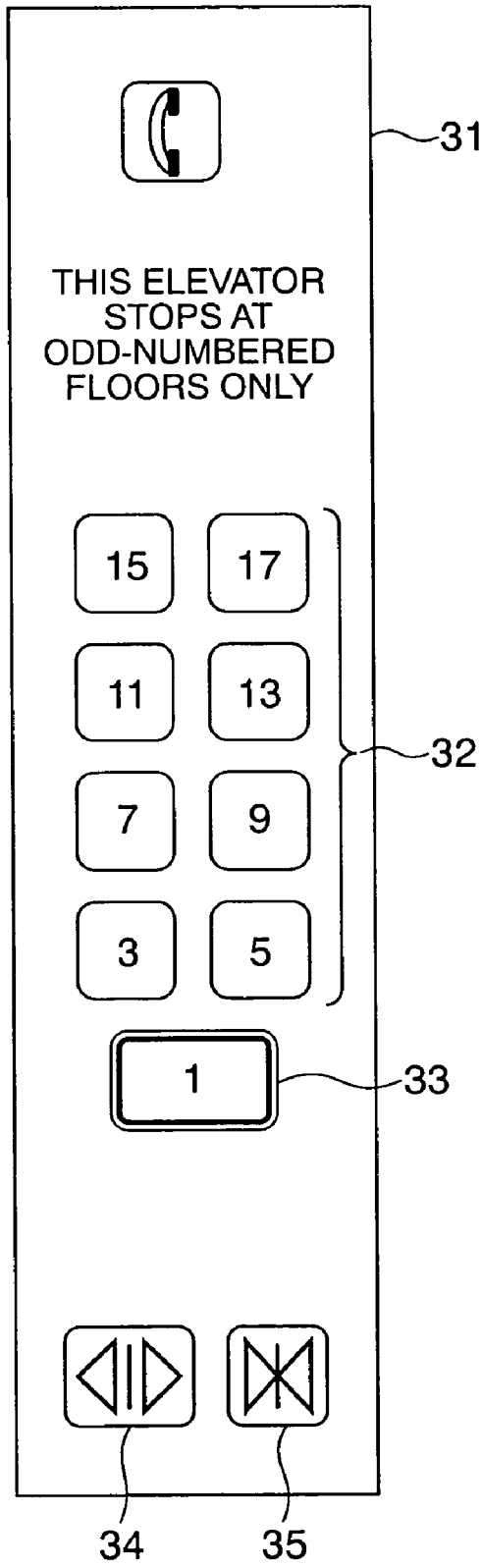
FIG. 9 is a front elevation showing an example of a lower cage button apparatus disposed in a lower cage of an elevator according to Embodiments 1 to 6.
Figure 10:
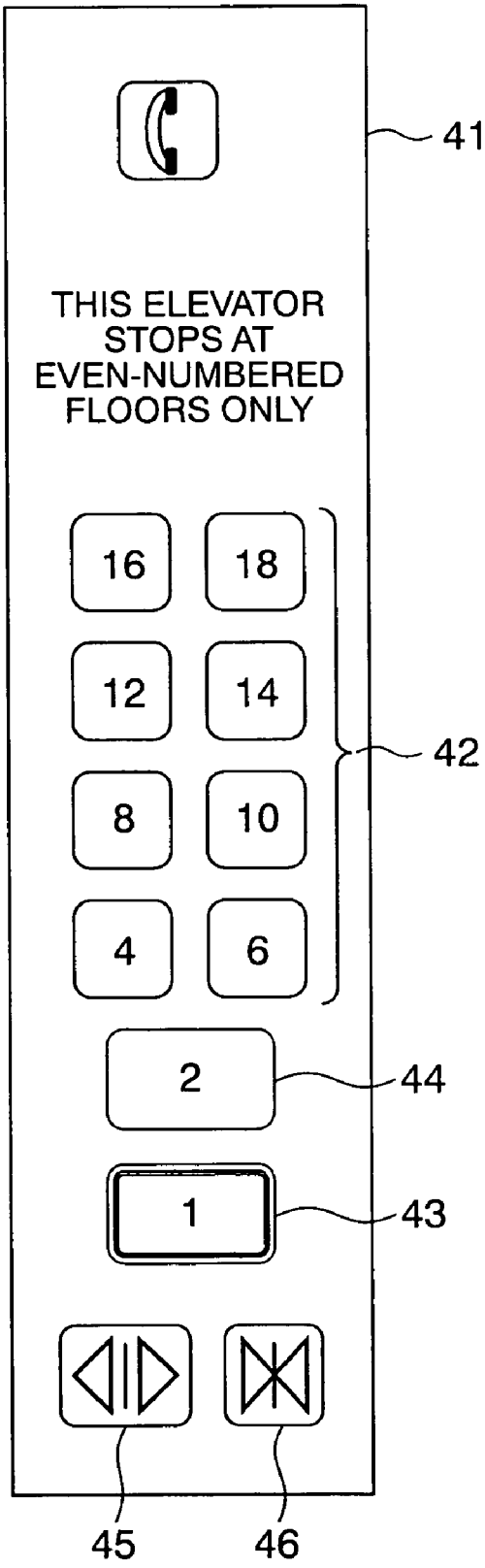
FIG. 10 is a front elevation showing an example of an upper cage button apparatus disposed in an upper cage of the elevator according to Embodiments 1 to 6.

Now, FIG. 9 is a front elevation showing an example of a lower cage button apparatus disposed in a lower cage of an elevator according to Embodiments 1 to 6, and FIG. 10 is a front elevation showing an example of an upper cage button apparatus disposed in an upper cage of the elevator.

A plurality of odd-numbered floor designating buttons 32 for designating (registering) lower cage stop floors 1*a* as destination floors are disposed on a lower cage button apparatus 31. Furthermore, buttons for designating upper cage stop floors 1*b* are not disposed on the lower cage button apparatus 31, and direct designation of upper cage stop floors 1*b* is impossible.

A first-floor designating button 33 for designating the first floor (1F) as a destination floor is disposed below the odd-numbered floor designating buttons 32. A door opening button 34 and a door closing button 35 are disposed below the first-floor designating button 33.

A plurality of the even-numbered floor designating buttons 42 for designating upper cage stop floors 1*b* as destination floors are disposed on an upper cage button apparatus 41. Furthermore, buttons for designating lower cage stop floors 1*a* are not disposed on the upper cage button apparatus 41, and direct designation of lower cage stop floors 1*a* is impossible.

A first-floor designating button 43 for designating the first floor (1F) as a destination floor and a second-floor designating button 44 for designating the second floor (2F) as a destination floor are disposed below the even-numbered floor designating buttons 42. A door opening button 45 and a door closing button 46 are disposed below the first-floor designating button 43 and the second-floor designating button 44.

Since direct designation of the upper cage stop floors 1*b* is impossible using the lower cage button apparatus 31, and direct designation of the lower cage stop floors 1*a* is impossible using the upper cage button apparatus 41 in this manner, the floors at which the lower cage 5 and the upper cage 6 stop can be communicated to passengers more clearly.

The upper cage 6 basically stops only at the upper cage stop floors 1*b* with the second floor (2F) as a departure floor. However, a first-floor designating button 43 is also disposed on the upper cage button apparatus 41. Thus, implementation of a control method in which the upper cage 6 is permitted to stop at the first floor (1F) during off-peak periods, for example, is also possible.

Figure 11:
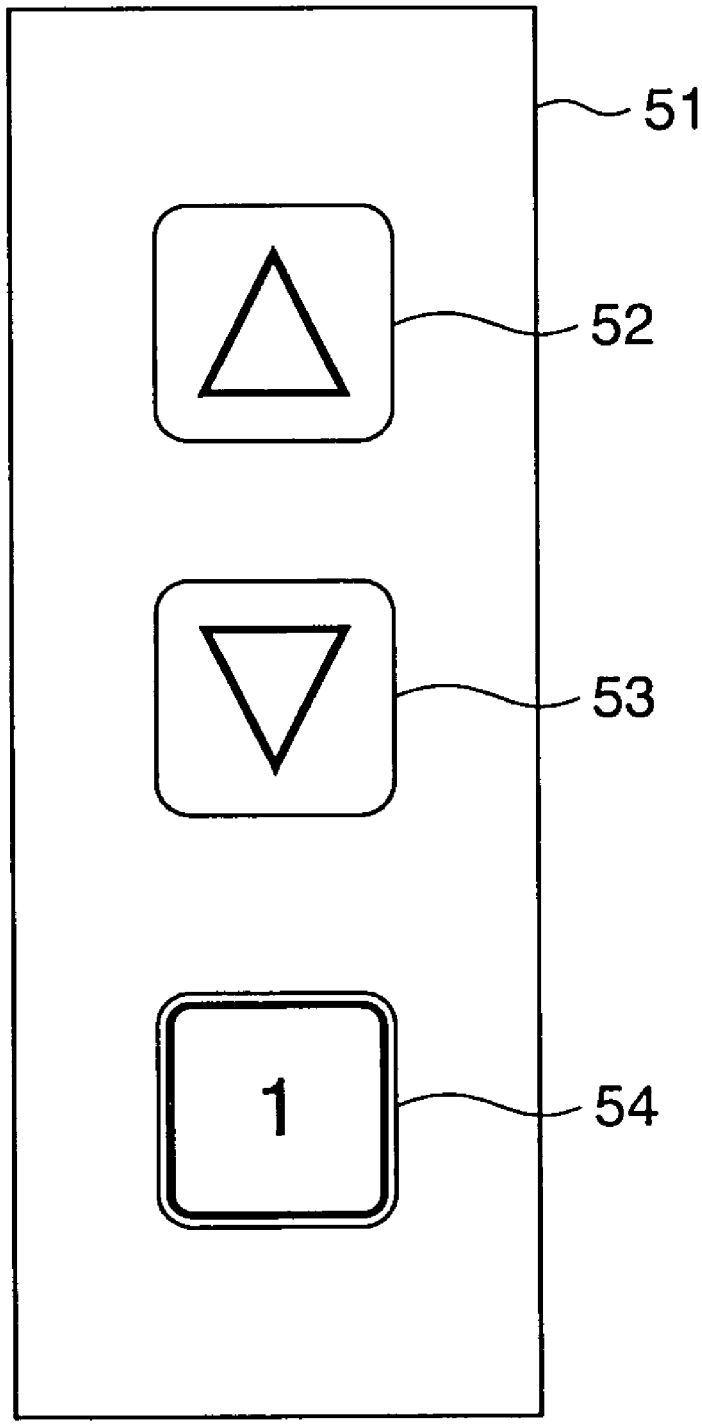
FIG. 11 is a front elevation showing an example of a landing button apparatus disposed on a lower cage stop floor of the elevator according to Embodiments 1 to 6.
Figure 12:
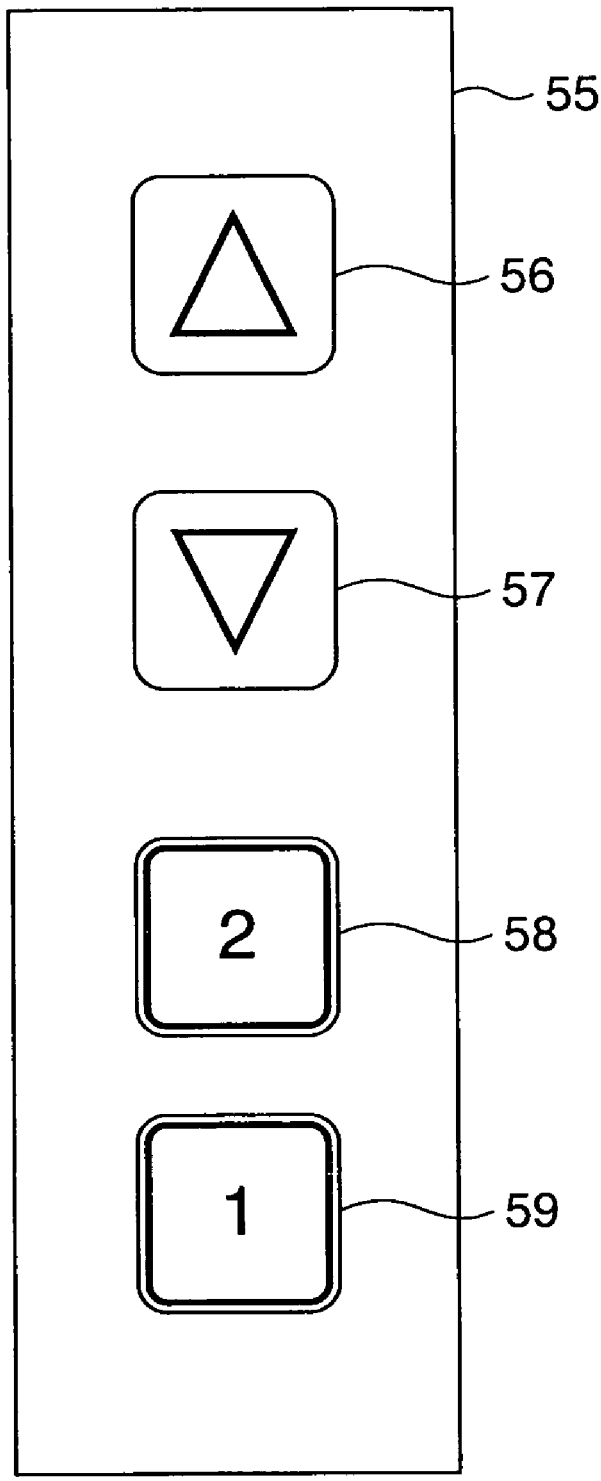
FIG. 12 is a front elevation showing an example of a landing button apparatus disposed on an upper cage stop floor of the elevator according to Embodiments 1 to 6.

Next, FIG. 11 is a front elevation showing an example of a landing button apparatus disposed on a lower cage stop floor of the elevator according to Embodiments 1 to 6, and FIG. 12 is a front elevation showing an example of a landing button apparatus disposed on an upper cage stop floor of the elevator according to Embodiments 1 to 6.

An up button 52, a down button 53, and a first-floor designating button 54 are disposed on a landing button apparatus 51 disposed on landings of the lower cage stop floors 1*a*.

An up button 56, a down button 57, a second-floor designating button 58, and a first-floor designating button 59 are disposed on a landing button apparatus 55 disposed on landings of the upper cage stop floors 1*b*.

Using landing button apparatuses 51 and 55 of this kind, if the destination floor is the first floor (1F) or the second floor (2F), which are entrance floors, registration for moving the car 3 to the landing and registration of the destination floor can be performed at the landing, enabling convenience for passengers to be improved. Also, if the destination floor is the first floor (1F) or the second floor (2F), since the destination floor is known before the passenger boards the car 3, transport efficiency can be improved by group control.

In the double operating mode, the entrance floor corresponding to the upper cage stop floors 1*b* is the second floor (2F), but by disposing a first-floor designating button 59 on the landing button apparatuses 55, if control permitting the upper cage 6 to stop at the first floor (1F) is performed as an option, it is possible to register the first floor (1F) as a destination floor from the upper cage stop floors 1*b*.

Moreover, methods for notifying passengers whether the first-floor designating button 59 of the landing button apparatus 55 is available include, for example, lighting up a vicinity of all of the buttons 56 through 59 when the first-floor designating button 59 is available, and switching off the light only in the vicinity of the first-floor designating button 59 when unavailable. A displaying means indicating availability or unavailability may also be disposed in the vicinity of the first-floor designating button 59.

EMBODIMENT 7

Figure 13:
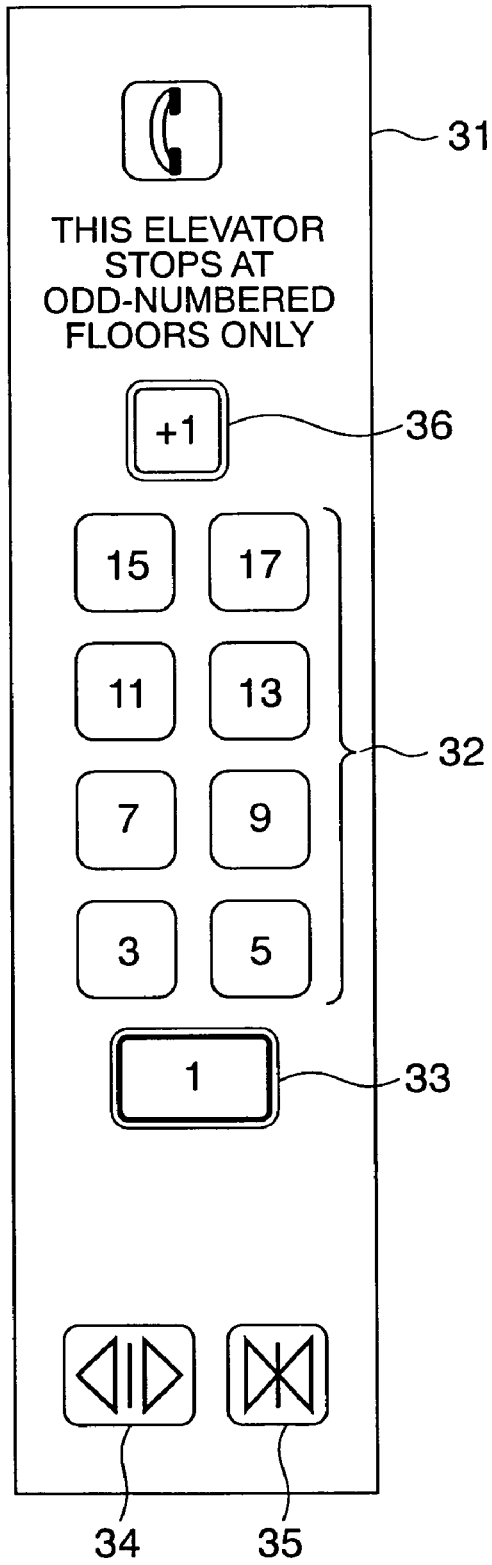
FIG. 13 is a front elevation showing a lower cage button apparatus of a multi-deck elevator according to Embodiment 7 of the present invention.
Figure 14:
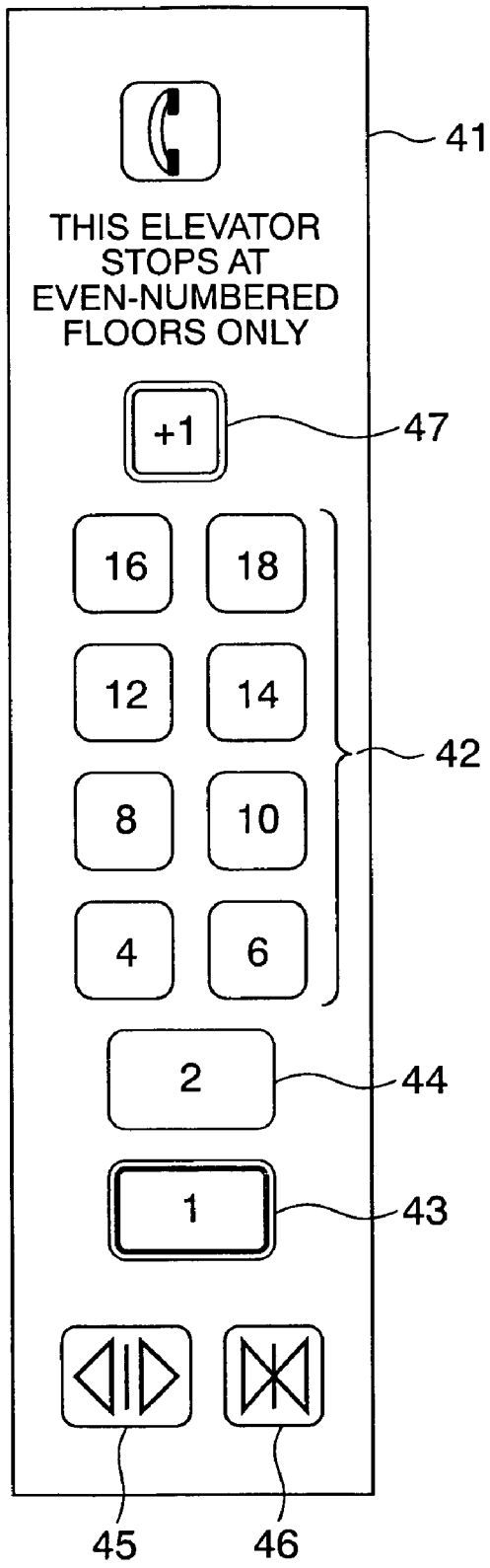
FIG. 14 is a front elevation showing an upper cage button apparatus of the multi-deck elevator in FIG. 13.

Next, FIG. 13 is a front elevation showing a lower cage button apparatus of a multi-deck elevator according to Embodiment 7 of the present invention, and FIG. 14 is a front elevation showing an upper cage button apparatus of the multi-deck elevator in FIG. 13. A multi-deck elevator according to Embodiment 7 is basically operated in a double operating mode in a similar manner to Embodiments 1 to 6. Here, a configuration in which button apparatuses in FIG. 13 and FIG. 14 are applied to an elevator according to Embodiment 1 (FIG. 1) will be explained.

Odd-numbered floor designating buttons (first direct designating buttons) 32, a first-floor designating button 33, a door open button 34, and a door close button 35 are disposed on a lower cage button apparatus (a first designating button apparatus) 31.

A first indirect designating button 36 operated in combination with the odd-numbered floor designating buttons 32 to indirectly designate an upper cage stop floor 1*b* as a destination floor is disposed above the odd-numbered floor designating buttons 32. Specifically, an upper cage stop floor 1*b* that is one floor above a floor chosen using an odd-numbered floor designating button 32 can be designated as a destination floor by operating the respective odd-numbered floor designating button 32 and the first indirect designating button 36 in combination with each other.

Even-numbered floor designating buttons (second direct designating buttons) 42, a first-floor designating button 43, a second-floor designating button 44, a door open button 45, and a door close button 46 are disposed on an upper cage button apparatus (a second designating button apparatus) 41.

A second indirect designating button 47 operated in combination with the even-numbered floor designating buttons 42 to indirectly designate a lower cage stop floor 1*a* as a destination floor is disposed above the even-numbered floor designating buttons 42. Specifically, a lower cage stop floor 1*a* that is one floor above a floor chosen using an even-numbered floor designating button 42 can be designated as a destination floor by operating the respective even-numbered floor designating button 42 and the second indirect designating button 47 in combination with each other.

In a multi-deck elevator of this kind, since the first indirect designating button 36 is disposed on the lower cage button apparatus 31, and the second indirect designating button 47 is disposed on the upper cage button apparatus 41, implementation of control in which the lower cage 5 can be stopped at upper cage stop floors 1*b* and the upper cage 6 can be stopped at lower cage stop floors 1*a*, etc., is made possible by making input from these in direct designating buttons 36 and 47 available.

In other words, by using button apparatuses 31 and 41 according to Embodiment 7, the number of choices of control methods can be increased while making it even clearer which destination floors can be designated in the double operating mode, enabling user friendliness to be improved.

Moreover, Embodiment 7 has been explained as it applies to an elevator according to Embodiment 1, but Embodiment 7 may also be applied to elevators according to Embodiments 2 to 6. Furthermore, Embodiment 7 can also be applied to multi-deck elevators other than those of Embodiments 1 to 6.

In Embodiment 7, a lower cage button apparatus 31 and an upper cage button apparatus 41 are shown as first and second designating button apparatuses, but the present invention can also be applied to button apparatuses disposed on landings. In other words, button apparatuses similar to that in FIG. 13 may also be installed on landings of the lower cage stop floors 1*a*, and button apparatuses similar to that in FIG. 14 installed on landings of the upper cage stop floors 1*b*. Thus, designation of destination floors can be implemented from the landings.

In addition, in the above embodiments, double-deck elevators having two cages are disclosed, but the present invention can also be applied to multi-deck elevators having three or more cages.

In the above embodiments, building main bodies that are constituted only by entrance floors, first cage stop floors, and second cage stop floors are disclosed, but shared stop floors at which both the first cage and the second cage stop, or floors at which neither cage stops, etc., may also be included in portions of a building main body.

The building main body is not limited to a particular number of floors, and a plurality of floors may also be disposed underground.

In addition, the entrance floors are not limited to the first floor (1F) and the second floor (2F), and may also be underground floors, or floors from the third floor (3F) upward, etc.

In the above examples, the first cage stop floors are odd-numbered floors, and the second cage stop floors are even-numbered floors, but that may also be reversed.

In the above examples, the first cage stop floors and the second cage stop floors are disposed so as to alternate, but they do not necessarily have to alternate, and the first cage stop floors may also be contiguous in part, for example. Furthermore, if three cages are disposed in the car, third cage stop floors will normally be positioned between the second cage stop floors and the first cage stop floors.

The invention claimed is:

1. A multi-deck-elevator-equipped building control system comprising:

an elevator control portion for controlling raising and lowering of an elevator car having a first cage and a second cage positioned above the first cage, the elevator car being raised and lowered inside a hoistway of a building; and a building fixture control portion for controlling electrical fixtures installed on respective floors of the building, wherein operating modes of the elevator control portion include a double operating mode in which only the first cage is permitted to stop at a plurality of first cage stop floors, and only the second cage is permitted to stop at a plurality of second cage stop floors that are distinct from the first cage stop floors, the building fixture control portion has a first group control portion for collectively controlling the electrical fixtures on all of the first cage stop floors, and a second group control portion for collectively controlling the electrical fixtures on all of the second cage stop floors, and, the electrical fixtures are selected from the group consisting of lighting apparatus, air conditioning apparatus, security systems, and audio apparatus.

2. The multi-deck-elevator-equipped building control system according to claim 1, wherein the building fixture control portion further comprises a tenant control portion for collectively controlling the electrical fixtures for the respective floors occupied by each respective tenant of the building.

3. The multi-deck-elevator-equipped building control system according to claim 1, including a first cage control portion for controlling first cage electrical equipment disposed in the first cage, wherein the first cage control portion is disposed in the elevator control portion such that the first cage control portion performs control in response to information from the first group control portion for at least a portion of the first cage electrical equipment.

4. The multi-deck-elevator-equipped building control system according to claim 1, including a second cage control portion for controlling second cage electrical equipment disposed in the second cage, wherein the second cage control portion is disposed in the elevator control portion such That the second cage control portion performs control in response to information from the second group control portion for at least a portion of the second cage electrical equipment.

* * * * *